United States Patent [19]

Calvo

[11] Patent Number: 4,968,041

[45] Date of Patent: Nov. 6, 1990

[54] GAME APPARATUS

[76] Inventor: R. David Calvo, 62 Greens Ward La., Sugar Land, Tex. 77479

[21] Appl. No.: 415,879

[22] Filed: Oct. 2, 1989

[51] Int. Cl.[5] ..... A63B 67/06

[52] U.S. Cl. ..... 273/401

[58] Field of Search ..... 273/398, 400, 401, 402, 273/424, 425, 336, 338

[56] References Cited

U.S. PATENT DOCUMENTS

| | | | |
|---|---|---|---|
| 1,541,980 | 6/1925 | Luber | 273/401 X |
| 2,287,113 | 6/1942 | Markey | 273/401 |
| 3,111,318 | 11/1963 | Northrup | 273/400 X |
| 3,892,407 | 7/1975 | Higgins | 273/336 |
| 4,012,042 | 3/1977 | Blasingame | 273/401 |
| 4,169,596 | 10/1979 | Chinenson | 273/401 |
| 4,243,229 | 1/1981 | Huser et al. | 273/402 |
| 4,717,156 | 1/1988 | Wright | 273/401 |

FOREIGN PATENT DOCUMENTS

| | | | |
|---|---|---|---|
| 421751 | 12/1934 | United Kingdom | 273/336 |

*Primary Examiner*—William H. Grieb

*Attorney, Agent, or Firm*—Bernard A. Reiter

[57] ABSTRACT

A game apparatus comprising a game board adapted for horizontal disposition and having an upstanding backboard and a pair of sideboards extending upwardly from the game board. The backboard, and sideboards and the playing board all defining playing surfaces at which a plurality of quoits are physically thrown by a player from a remote position in attempt to land the quoit, by direct hit or by rebound, into a target cup recessed in and below the playing surface. The sideboards are each characterized by a sloped upper wall each sideboard define a frontal approach by the player to the playing board so as to encourage tossing of the quoits from the front or from the side, either by tossing the quoit, rebounding it or rolling it into the scoring cup.

8 Claims, 1 Drawing Sheet

GAME APPARATUS

BACKGROUND OF THE INVENTION

1. Field of the Invention

The present invention is directed to games and more particularly to games of skill involving the tossing of playing pieces, in the form of quoits, discs or the like angularly or directly toward a playing board having a scoring cup recessed in the surface thereof.

Games of skill in which playing pieces are tossed towards a goal have long existed in the form of horseshoes, ring tosses and the like, tossed by players toward a stake. The games are adapted for either indoor or outdoor use although certain of them, such as horseshoes are commonly played only outdoors because of the size of the playing piece (the horseshoe) or the amount of space in which the game inherently must be played. Other games such as coin or quoit tosses may be played both indoor or outdoor in a room or on lawns, playgrounds, patios or similar areas. Although these various games historically may be played by persons of any age some are more commonly played by adults than by children, i.e., horseshoes. The present game may be played either indoor or out, by adults or by children and is conceived to provide enjoyment, challenge and competition, for all ages of players in a novel manner.

SUMMARY OF THE INVENTION

The game apparatus of the invention generally comprises a horizontally disposed playing surface characterized preferably by four sides and which includes three upstanding surfaces extending from three of the sides. The three sides constitute a backboard and adjacent sideboards. One of the sides to the playing surface therefore remains open and defines the "approach" side used by competing players who endeavor to toss quoits into a cup which is recessed within and below the playing surface. Each of the sideboards further is characterized by a sloping configuration in which the higher part of the sideboard exists in adjacent relation to the backboard and the lower part of the sideboards exist at the "approach" side of the playing surface so that players may toss their quoits either directly obliquely at the backboard, or they may skip the quoit from the ground in front of the playing board and onto its playing surface or they may toss the quoit directly into the scoring cup or in rebounding manner against and off of the sideboards and or backboard.

DETAILED DESCRIPTION OF THE INVENTION

Figure 1:
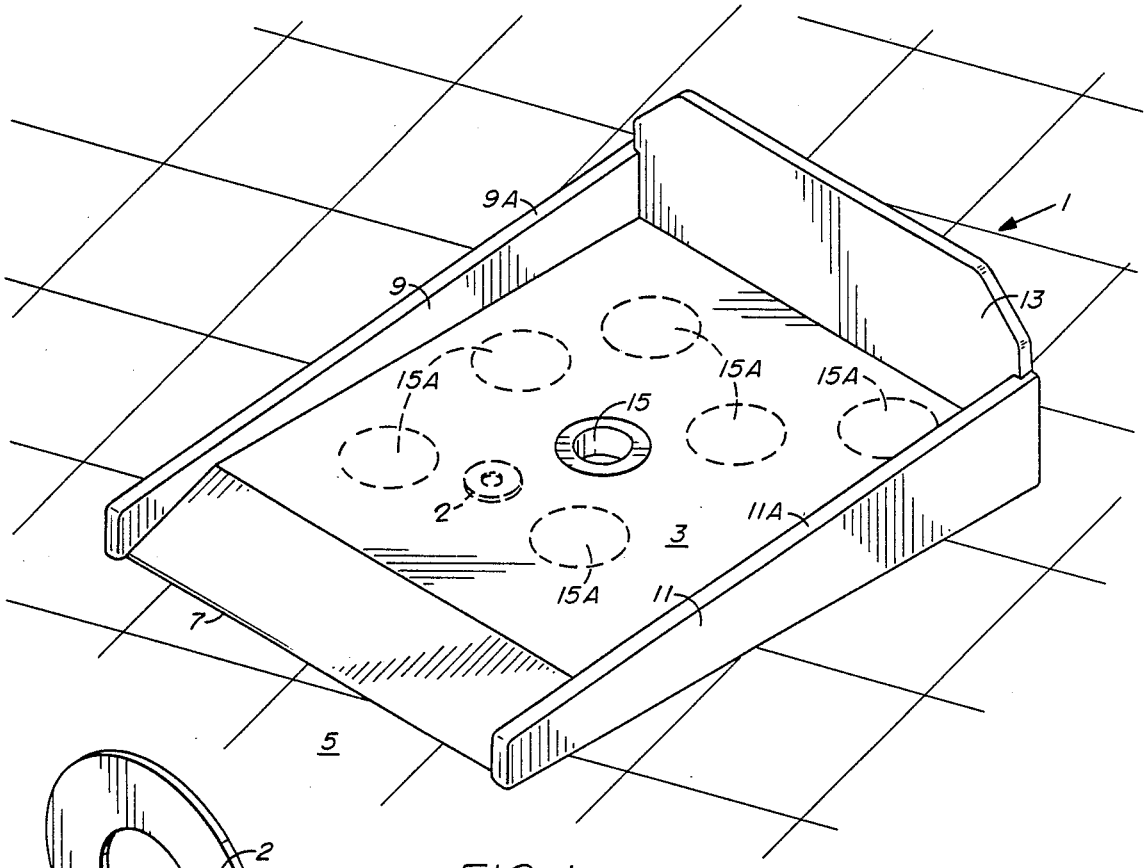
FIG. 1 is a perspective view of the apparatus of the game.

Referring now to the drawings by characters of reference, the apparatus 1 of the game includes a playing surface or board 3 substantially horizontally disposed and residing substantially flush with the support surface 5 on which it sits. The playing board 3 is characterized by a clearly open side defined by an edge 7 constituting the players approach edge for quoits 2 or other objects tossed. It will be recognized upon further explanation that the quoits may be thrown at an angular direction over t he downwardly sloping side walls described hereafter. It is intended that the approach edge 7 may be used as part of the "game" to be used by the players who may choose to roll and "bounce" their respective quoit into the target cup 15, or they may rebound their respective quoit against either of the sideboards 11(*a*), 11(*b*) or backboard 13.

The apparatus 1 of the game is further defined by the upwardly directed sideboards 9, 11 each of which may include an upwardly sloping surface 9(*a*), 11(*a*) increasing in height from the approach side of the board 3 to the back side which is defined by backboard 13. The backboard 13 extends upwardly from the playing board 3 and, in cooperation with the sideboards 9, 11 is intended to provide the rebound surface for the flying, bouncing and/or rolling quoits being tossed by the competing players.

Appropriately disposed in recessed fashion within the surface of the playing board 3 is a target cup 15 which preferably is characterized by an open bottom enabling the quoits tossed thereinto to rest thereon., It should be recognized however that the target cup 15 may have a lip 15(*c*) at the bottom which precludes the quoit from falling through and which because of the opening in the quoit may be easily retrieved by inserting a finger into the quoit. The open bottom of the board 3 however, in the alternative, facilitates retrieval of the quoits by the competing players who need only lift the front end of apparatus 1 to easily reach them. The target cup 15 though shown in circular configuration disposed substantially in the center of the playing board 3 may exist in any other configuration and may be placed in a position other than in the center of the playing board while still complying with the objects of and competing spirits engendered by playing of the game. Provisions may be made for easy movement of the scoring cup by having a plurality of alternative cut-outs 15(*a*) in the playing board and which are easily removable and refittable by reason of gently sloping sides 15(*b*) which receive the cooperating insert cut-out 15(*a*) or target cup 15.

OPERATION OF THE APPARATUS (PLAYING OF THE GAME)

In playing of the game, the first player takes more than one of the playing quoits (the number to be determined by choice of the players) and, at a distance from the apparatus 1 (also chosen by the players) endeavors to "toss" a quoit toward the target cup 15. The toss actually may constitute a physical effort to roll the quoit past the approach area directly into the cup or it may encompass a physical effort to literally toss the quoi onto the support surface in front of the approach edge 7 so that it rebounds from the surface (5) onto the playing board 3 and directly into the target cup 15 or, still further onto and against either o±the rebounding sideboards 9, 11 and/or the backboard 13, before entry into the target cup 15. Likewise, a competing player may choose to not toss his quoit in the direct approach manner over the leading edge 7 but instead may choose to toss the quoit obliquely over either of the sloped sideboards 9, 11. In this regard he may choose to toss the quoit over either of the lower (frontal approach) extremities of the sideboards 9, 11, thus intending to "limit the rebound" by "socking" the quoit into the abutting corners of the backboard 13 (where backboard meets the sideboards 9, 11). This particular type of toss physically limits the rebound tendency and constitutes the principal reason for the downwardly sloping surface 9(*a*), 11(*a*) of the sideboards 9, 11 respectively. Generally speaking this type of toss is characterized by a relatively low "flinging" approach of the quoit toward the target cup 15.

Figure 2:
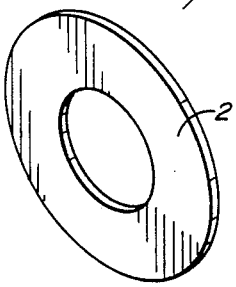
FIG. 2 is a perspective view of one of the pieces that may be thrown at the game apparatus of FIG. 1.
Figure 3:
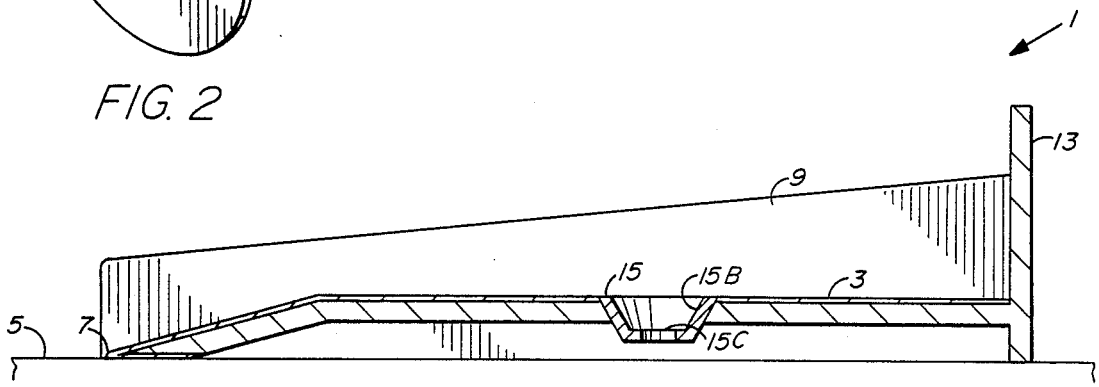
FIG. 3 is a sectional view of the apparatus of FIG. 1.
Figure 4:
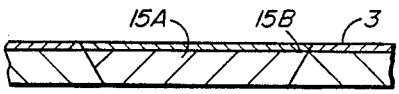
FIG. 4 is an enlarged sectional view of one of the removable cutouts.

The quoits which are described herein and are shown in FIG. 2 preferably consist of washer shaped articles which may be made of highly polished copper, brass, other metals or materials. Naturally the diameter of the target cup is larger than that of the largest dimension of each of the quoits. The apparatus 1 of the game should be made preferably of a relatively hard wood but may be made of other materials so long as the material can withstand the physical abuse imparted to it by the tossed quoits. An oak or mahogany is preferred as it imparts to the game a predictable resiliency to the rebounding of the tossed quoits. The game is preferably played at a distance of approximately 15 to 20 feet but as indicated above the distance is left to the discretion of the player, providing that all players toss from the same distance (in the absence of a handicap arrangement).

In the scoring of the game a single quoit generally is "lagged" onto the board by each player or team. The closest to the hole is allowed to toss his quoits first and he is followed by the second player. The teams generally will alternate members, each tossing their quoits until all have been thrown. Scoring may take place by any mutually chosen method.

From the foregoing description it will be appreciated that there is here provided an improved game of skill which is particularly entertaining for both small children and adults, inside or out and which is markedly inexpensive to manufacture. It will further be appreciated that the herein described game be modified without departing from the spirit and scope of the concept herein described. For example, the sideboards and backboard may be angled in differing degrees with respect to one another and the scoring cup may be positioned in different relationships thereto. Likewise the scoring cup and scoring quoits may take different form, all without departing from the spirit of the invention here disclosed while remaining within the scope of the following claims.

Therefore, that which is claimed and desired to be secured by United States Letters Patent is:

1. A game apparatus involving the use of playing pieces intended to be physically tossed toward the apparatus in an effort to achieve a highest score, the playing pieces constituting a plurality of objects which are thrown toward a target area disposed on the apparatus, comprising:

a playing board substantially horizontally disposed and which rests in flush position against the floor and which includes a plurality of sides, one of said sides being oriented to face the direction from which the playing pieces approach the playing board;

the playing board further including a plurality of upstanding sideboards and backboard, said backboard being oriented to face the direction from which the playing pieces approach the playing board, the backboard and the sideboards being oriented to cooperatively provide rebound surfaces for the playing pieces which are tossed thereat;

a cutout within the surface of the playing board for receiving a target cup;

a target cup disposed within the cutout and sitting flush with respect to the surface of the playing area so that playing pieces may roll into the target cup from the playing surface or rebound thereinto from any of said upstanding back and/or sideboards; and each said sideboard being characterized by an end thereof adjacent to the approach side of the playing board and another end thereof which is adjacent to the backboard of the playing surface, the sideboards further being characterized each by an upper surface which slopes downwardly from the end thereof proximate the backboard toward the end thereof proximate the approach side so that playing pieces may be more readily tossed upon the playing surface from an approach direction which is to either side and in front of the playing surface.

2. The apparatus of claim 1, wherein the backboard is upstanding from the playing surface to a height which is higher than any height of the sideboards.

3. The apparatus of claim 1, wherein the playing surface is characterized by a plurality of cut-outs; each of said cut-outs further including an insert so that each of the cut-outs may alternatively receive the target cup while cut-outs not occupied by the target cup are in receipt of their respective insert so that only one opening thus exists within the playing board.

4. The apparatus of claim 3, wherein each of the cut-outs is characterized by an opening through the playing surface and extending there through while receiving the target cup therein, the target cup being characterized by an open bottom extending through to the surface supporting the playing board.

5. The apparatus of claim 4, wherein the target cup and the cut-outs in the playing board is characterized by cooperative parallel walls which slope inwardly toward the center of the target cup when viewed from top to the bottom thereof so that the target cup is adapted to fit frictionally within the cut-outs in the target board.

6. The apparatus of claim 1, wherein the cup is characterized by a lip therein which precludes the playing pieces from dropping therethrough.

7. The apparatus of claim 6, wherein the playing pieces contain a hole therein for facilitating retrieval of the pieces from the target cup.

8. The apparatus of claim 1, wherein the target cup is characterized by sloping sides which cooperatively fit with said cut-out in the surface of the laying board so as to facilitate removal of the cup from the board surface.

* * * * *